US006415617B1

(12) United States Patent
Seem

(10) Patent No.: US 6,415,617 B1
(45) Date of Patent: Jul. 9, 2002

(54) MODEL BASED ECONOMIZER CONTROL OF AN AIR HANDLING UNIT

(75) Inventor: John E. Seem, Glendale, WI (US)

(73) Assignee: Johnson Controls Technology Company, Plymouth, MI (US)

( * ) Notice: Subject to any disclaimer, the term of this patent is extended or adjusted under 35 U.S.C. 154(b) by 0 days.

(21) Appl. No.: 09/757,952

(22) Filed: Jan. 10, 2001

(51) Int. Cl.[7] ..... F25D 17/04; F24F 3/00; F15B 5/00; G05D 16/00

(52) U.S. Cl. ..... 62/186; 165/205; 165/208; 165/209; 165/212; 165/222; 165/249; 137/84; 62/271

(58) Field of Search ..... 62/176.6, 271, 62/186; 137/84; 165/205, 208, 209, 212, 217, 222, 249, 250, 251

(56) References Cited

U.S. PATENT DOCUMENTS 4,183,224 A * 1/1980 Rule et al. ..... 62/271
4,199,101 A * 4/1980 Bramow et al. ..... 165/222
4,263,931 A * 4/1981 Bramow et al. ..... 137/84
4,283,007 A * 8/1981 Bramow et al. ..... 165/222
4,293,027 A * 10/1981 Tepe et al. ..... 165/250
4,347,712 A * 9/1982 Benton et al. ..... 165/212
4,485,632 A * 12/1984 Gallagher ..... 165/249
4,491,061 A * 1/1985 Nishizawa et al. ..... 165/208
4,549,601 A * 10/1985 Wellman et al. ..... 165/205
4,570,448 A * 2/1986 Smith ..... 165/251
4,635,445 A * 1/1987 Otsuka et al. ..... 165/217
4,754,919 A * 7/1988 Otsuka et al. ..... 165/205
4,890,666 A * 1/1990 Clark ..... 165/208
5,058,388 A * 10/1991 Shaw et al. ..... 62/176.6
5,544,697 A * 8/1996 Clark ..... 165/209
5,791,408 A 8/1998 Seem ..... 165/250
6,006,142 A 12/1999 Seem et al. ..... 700/276
6,298,912 B1 * 10/2001 Rayburn et al. ..... 165/217

* cited by examiner

*Primary Examiner*—William Doerrler
*Assistant Examiner*—Filip Zec
(74) *Attorney, Agent, or Firm*—Foley & Lardner

(57) ABSTRACT

A strategy for controlling an air side economizer of an HVAC system uses a model of the airflow through the system to estimate the load in two modes when minimum and maximum amounts of outdoor air are being introduced into the building. Transitions between minimum outdoor air and maximum outdoor air usage occur based on those estimated loads, which in a preferred embodiment are cooling loads. The second embodiment of this economizer control strategy uses the model and a one-dimensional optimization routine to determine the fraction of outdoor air that minimizes the load on the HVAC system.

20 Claims, 4 Drawing Sheets

10
36
34
T
H
20
23
16
14
25
26
18
28
ROOM
12
22
30
32
27
29
38
39
AIR HANDLING
UNIT CONTROLLER
24

100%
90%
80%
70%
60%
50%
40%
30%
20%
10%
STATE 4
STATE 3
STATE 2
0.030
0.025
0.020
0.015
0.010
0.005
HUMIDITY RATIO
40
50
60
70
80
90
100
110
120
TEMPERATURE

MODEL BASED ECONOMIZER CONTROL OF AN AIR HANDLING UNIT

BACKGROUND OF THE INVENTION

The present invention relates to control air handling units of an heating, ventilation and air conditioning system, and more particularly to regulating the amount of outdoor air that is introduced into the system in order to reduce the amount of mechanical heating and cooling required.

FIG. 1 conceptually illustrates a typical single duct air handling unit (AHU) 10 of a heating, ventilation and air conditioning (HVAC) system which controls the environment of a room 12 in a building. Air from the room is drawn into a return duct 14 from which some of the air flows through a return damper 16 to a supply duct 18. Some of the return air may be exhausted outdoor the building through an outlet damper 20 and replenished by fresh outdoor air entering through an inlet damper 22. There always is a minimum amount of fresh outdoor air entering the system for proper ventilation within the building. The dampers 16, 20, and 22 are opened and closed by actuators which are operated by a controller 24 to control the ratio of return air to fresh outdoor air. The mixture of return air and fresh outdoor air is forced by a fan 25 through a cooling coil 26 and a heating coil 28 before being fed into the room 12.

The controller 24 also operates a pair of valves 27 and 29 that regulate the flow of chilled fluid through the cooling coil 26 and the flow of heated fluid through the heating coil 28, depending upon whether the circulating air needs to be cooled or heated. These coils 26 and 28 provide "mechanical" heating and cooling of the air and are referred to herein as "mechanical temperature control elements." The amount of cooling or heating energy that is required to be provided by mechanical temperature control elements is referred to herein as a "mechanical load" of the HVAC system.

Sensors 30 and 32 respectively measure the temperature and humidity of the outdoor air and provide signals to the controller 24. Another pair of sensors 34 and 36 respectively measure the temperature and humidity of the air in the return duct 14. Additional temperature sensors 38 and 39 are located in the outlet of the supply duct 18 and in the room 12.

The controller 24 executes a software program that implements an air side economizer function that uses outdoor air to reduce the mechanical cooling requirements for the air handling unit 10. There are three air side economizer control strategies that are in common use: temperature, enthalpy, and temperature and enthalpy. The strategies control transitions between two air circulation modes: minimum outdoor air with mechanical cooling and maximum outdoor air with mechanical cooling.

In temperature economizer control, an outdoor air temperature is compared to the return temperature or to a switch-over threshold temperature. If mechanical cooling is required and the outdoor air temperature is greater than the return air temperature or the switch-over threshold temperature, then a minimum amount of outdoor air required for ventilation (e.g. 20% of room supply air) enters air-handling unit 10. If mechanical cooling is required and the outdoor air temperature is less than the return temperature or a switch over threshold temperature, then a maximum amount of outdoor air (e.g. 100%) enters the air-handling unit 10. In this case, the outlet damper 20 and inlet damper 22 are opened fully while the return damper 16 is closed.

With enthalpy economizer control, the outdoor air enthalpy is compared with the return air enthalpy. If mechanical cooling is required and the outdoor air enthalpy is greater than the return air enthalpy, then the minimum amount of outdoor air required for ventilation enters the air-handling unit. Alternatively when mechanical cooling is required and the outdoor air enthalpy is less than the return air enthalpy, then the maximum amount of outdoor air enters the air-handling unit 10.

With the combined temperature and economizer control strategy, when mechanical cooling is required and the outdoor temperature is greater than the return temperature or the outdoor enthalpy is greater than the return enthalpy, the minimum amount of outdoor air required for ventilation is used. If mechanical cooling is required and the outdoor temperature is less than the return air temperature and the outdoor enthalpy is less than the return enthalpy, then the maximum amount of outdoor air enters the air-handling unit. The parameters of either strategy that uses enthalpy have to be adjusted to take into account geographical environmental variations.

The present invention is an alternative to these three previously used control strategies.

SUMMARY OF THE INVENTION

A novel control strategy for controlling air side economizer has been developed for an HVAC system. The first embodiment of this economizer control strategy uses a model of the airflow through the system to estimate the mechanical load of the HVAC system, such as the load on a cooling coil for example, for minimum and maximum outdoor airflow into the HVAC system. Transitions between minimum outdoor air and maximum outdoor air usage occur based on those estimated mechanical loads. The second embodiment of this economizer control strategy uses the model and a one-dimensional optimization routine to determine the fraction of outdoor air that minimizes the mechanical load on the HVAC system.

The environment of a room in a building is controlled by calculating a first load on the mechanical temperature control element based on a first flow rate of outdoor air into the room, and calculating a second load based on a second flow rate of outdoor air into the room. In the preferred embodiment of the control method the first flow rate is the maximum amount of outdoor air and the second flow rate is the minimum amount of outdoor air that is required for adequate ventilation in the room.

The first and second loads on the mechanical temperature control element are compared, and the flow rate of outdoor air into the room is regulated in response to the comparison. In the preferred operation of this control strategy, the first flow rate is used when the first load is less than the second load; and outdoor air flows into the room 12 of the building at the second when the second load is less than the first load.

Another embodiment of the present invention involves deriving a fractional flow rate of outdoor air which is between the first and second flow rates. For example, a model of the airflow through the HVAC system is used to determine the optimum fractional flow rate. In this case, a calculation is made of a third load on a mechanical temperature control element based on fractional flow rate of outdoor air being introduced into the room. The third load is used along with the first and second loads to determine the amount of outdoor air to be introduced into the room.

In this embodiment, the first amount of outdoor air is introduced into the room when the second load is greater than the first load and the third load is greater than the first load. The second amount of air is introduced into the room when the first load is greater than the second load, and the third load is greater than the second load. Finally, outdoor air is introduced into the room at the third flow rate when the second load is greater than the third load and the first load is greater than the third load.

DETAILED DESCRIPTION OF THE INVENTION

Figure 1:
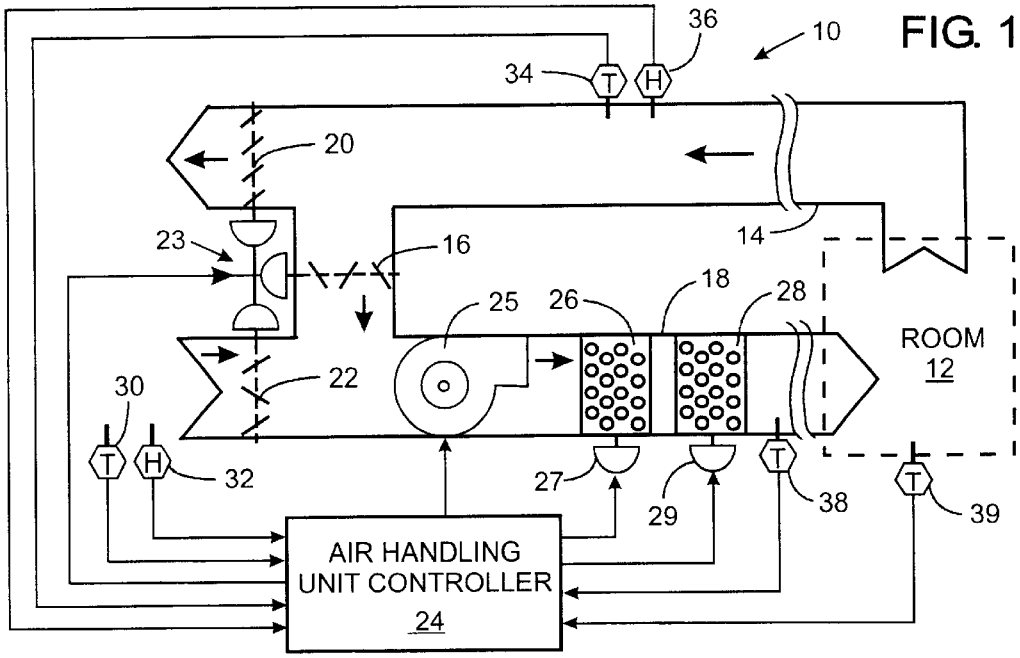
FIG. 1 is a diagram of a standard air handling unit in an HVAC system in which the present invention has been incorporated.

The present invention is implemented in software which is executed by the air handling unit controller 24 shown in FIG. 1. The underlying software configures the controller as a finite state machine that has four states depicted in FIG. 2. A transition occurs from one state to another, as indicated by the arrows, when a specified condition or set of conditions occurs. In the preferred embodiment, the operational data of the air handling unit is checked when the controller is in a given state to determine whether a defined transition condition exists. A number of the transition conditions are specified in terms of the control being "saturated" in the present state. Saturation occurs when controller remains in a given operating mode for a predetermined period of time without being able to adequately control the environment of the building. For example, saturation occurs in a mechanical cooling mode when the system is unable to cool the room to the desired temperature within a reasonable amount of time.

In State 1, the valve 29 for the heating coil 28 is controlled to modulate the flow of hot water, steam, or electricity to the heating coil, thereby controlling the amount of energy transferred to the air. This maintains the room temperature at the setpoint. The dampers 16, 20 and 22 are positioned for a minimum flow rate of outdoor air and there is no mechanical cooling, (i.e. chilled water valve 27 is closed). The minimum flow rate of outdoor air is the least amount required for satisfactory ventilation in the room, for example 20% of the air supplied to the room is outdoor air. The condition for a transition to State 2 is defined by the heating control signal being saturated in the "No Heat Mode". Such saturation occurs when the valve 29 of the heating coil 28 remains closed for a defined period of time, i.e. heating of the supply air is not required during that period. This transition condition can result from the outdoor temperature rising to a point at which the interior of the room does not need mechanical heating.

In State 2, the dampers 16, 20 and 22 alone are used to control the supply air temperature in duct 18, i.e. no mechanical heating or cooling. In this state the amount of outdoor air that is mixed with the return air from the room is regulated to heat or cool the air being supplied to the room 12. Because there is no heating or mechanical cooling, the inability to achieve the setpoint temperature results in a transition to either State 1 or 3. A transition occurs to State 1 for mechanical heating when either for a defined period of time the flow of outdoor air is less than that required for proper ventilation or the outdoor air inlet damper 22 remains in the minimum open position for a given period of time, denoted as X seconds. The finite state machine makes a transition from State 2 to State 3 for mechanical cooling upon the damper control being saturated in the maximum outdoor air position (e.g. 100% of the air supplied to the room is outdoor air).

In State 3, the chilled water valve 27 for the cooling coil 26 is controlled to modulate the flow of chilled water and control the amount of energy removed from the air. At this time, the dampers 16, 20 and 22 are positioned to introduce a maximum amount of outdoor air into the AHU 10. Obviously there is no heating in this state. A transition occurs to State 2 when the mechanical cooling does not occur for the given period of time, i.e. the cooling control is saturated in the no cooling mode.

Transitions between States 3 and 4 are based on estimates of the load that is exerted on the cooling coil 26 when outdoor air flows into the AHU at minimum and with maximum flow rates. Thus in both of those states the air handling controller performs those estimations. The three principal steps involved in the estimation process are: (1) determine the mixed air conditions from the fraction of outdoor air in the room supply air and from the outdoor and return air conditions, (2) determine the desired air temperature after the cooling coil from the setpoint temperature and an estimate of the heat gain from the fan 25, and (3) estimate the load exerted on the mechanical cooling coil 26. Since States 3 and 4 control cooling of the room air, the particular mechanical temperature control element for which the load is being estimated in the cooling coil 26. However, one skilled in the art will appreciate that the present inventive concept may also be employed in heating states where mechanical temperature control element is the heating coil 28.

The mixed air humidity ratio $\omega_m$, and enthalpy $h_m$, are determined from the expressions:

$$\omega_m = \frac{\dot{m}_o}{\dot{m}_s}\omega_o + \left(1 - \frac{\dot{m}_o}{\dot{m}_s}\right)\omega_r \tag{1}$$

$$h_m = \frac{\dot{m}_o}{\dot{m}_s}h_o + \left(1 - \frac{\dot{m}_o}{\dot{m}_s}\right)h_r \tag{2}$$

where $\omega_o$ and $\omega_r$, are the outdoor air and return air humidity ratios, respectively; $\dot{m}_o$ and $\dot{m}_s$ are the mass flow rate of the outdoor air and supply air, respectively; and $h_o$, and $h_r$, are the enthalpy of the outdoor air and return air, respectively. Therefore, the term $\dot{m}_o/\dot{m}_s$ represents the fraction of outdoor air in the air being supplied to the room, (i.e. 0.20 or 1.00 for the state machine depicted in FIG. 2). The humidity ratios and enthalpy for the outdoor air and return air are determined from temperature and relative humidity measurements provided from sensors 30, 32, 34, and 36 and by psychometric equations provided by the 1997 *ASHRAE Handbook—Fundamentals,* Chapter 6, American Society of Heating, Refrigerating and Air-Conditioning Engineers, 1997; and ASHRAE, *Psychrometrics—Theory and Practice,* American Society of Heating, Refrigerating, and Air-Conditioning Engineers, ISBN 1-883413-39-7, Atlanta, Ga., 1996.

The air temperature after the cooling coil 26 is determined from the setpoint temperature for the supply air and an estimate of the temperature rise across the fan as determined from the equation:

$$T_S - T_C = \frac{P_S - P_C}{\rho C_p \eta_O} \tag{3}$$

where ρ is the air density, $c_p$ is the constant pressure specific heat, $\eta_o$ is the overall efficiency of the components in the duct. $P_S$–$P_C$ equals the pressure rise across the fan, and $T_s$ and $T_c$ are the supply air and chilled air temperature, respectively. The chilled air temperature is the bulk air temperature after the cooling coil. The overall efficiency can be determined by multiplying the efficiencies of the components in the duct. If the fan, drive, and motor are all in the duct, then the overall efficiency $\eta_o$ is determined from $$\eta_o = \eta_{fan}\, \eta_{drive}\, \eta_{motor} \tag{4}$$

where $\eta_{fan}$ is the fan efficiency, $\eta_{drive}$ is the efficiency of the drive, and $\eta_{motor}$ is the motor efficiency. The fan efficiency is the ratio of work output to mechanical input, the drive efficiency is the ratio of electrical output to input, and the motor efficiency is the ratio of mechanical output to electrical input.

A number of different models can used to estimate the load exerted on the cooling coil. However, a preferred technique determines the cooling load from a bypass factor approach as described by Kuehn et al., *Thermal Environmental Engineering,* Prentice-Hall Inc., Upper Saddle River, N.J., 1998.

In that technique, a determination first is made whether the cooling coil is dry. The following equation is employed to determine the temperature at which the coil transitions between a dry condition and a partially wet condition:

$$T^* = \beta T_m + (1-\beta) T_{dew,m} \tag{5}$$

where T* is the transition temperature, β is the coil bypass factor, $T_m$ is the mixed air temperature, and $T_{dew,m}$ is the dew point temperature of the mixed air. The mixed air temperature and dew point temperature can be determined from Equations 1 and 2, and the psychometric equations presented in *ASHRAE Handbook—Fundamentals,* supra. If the cool air temperature is greater than the transition temperature as determined with Equation 5, the coil is dry, otherwise the coil is partially wet or wet.

If the coil is dry, then the cooling load is derived from the expression:

$$\frac{\dot{Q}_c}{\dot{m}_a} = h_m - h_c \tag{6}$$

where $\dot{Q}_C$ is the cooling load, $\dot{m}_a$ is the mass flow rate of dry air, and $h_m$ and $h_C$ are the enthalpy of the mixed air and cooled air, respectively. The enthalpies are determined from the mixed air temperature and relative humidity, the cooled air temperature, the psychometric equations presented in 1997 *ASHRAE Handbook— Fundamentals,* supra and the following equation:

$$\mathbf{107}_{c} = \omega_m \tag{7}$$

If the coil is not dry, then the cooling load is derived from the expression:

$$\frac{\dot{Q}_c}{\dot{m}_a} = (1-\beta)(h_m - h_d) - h_w(1-\beta)(\omega_m - \omega_d) \tag{8}$$

where β is the coil bypass factor, $h_d$ and $w_C$ are the enthalpy and humidity ratio of the saturated air, and $h_w$ is the enthalpy of condensate. The dew point temperature $T_{dew}$ for the saturated air is determined from:

$$T_{dew} = \frac{T_c - \beta T_m}{1-\beta} \tag{9}$$

Figure 3:
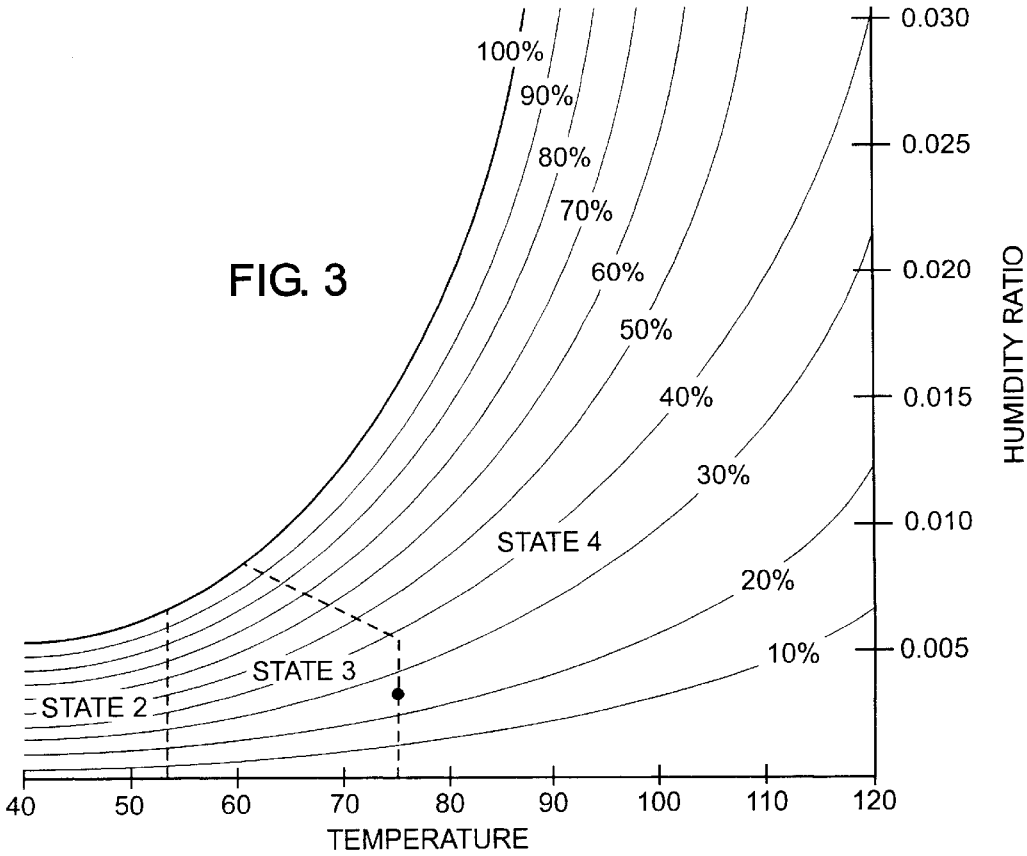
FIG. 3 is an examplary psychometric chart depicting operation of the four states in FIG. 2 for a specific set of environmental conditions.

The enthalpy and the humidity ratio for the saturated air in Equation 8 is determined from the dew point temperature and the ASHRAE psychometric equations. Assuming that the minimum fraction of outdoor air was set to 20% for the return conditions and a coil bypass factor of 0.2, FIG. 3 graphically depicts the control state regions on a psychometric chart.

Therefore, referring again to FIG. 2, a transition occurs from State 3 to State 4 when the estimated cooling load with a minimum flow of outdoor air is less than the estimated cooling load with a maximum flow of outdoor air for a given period of X seconds.

In State 4, the cooling coil 26 is active to apply mechanical cooling to the air while the dampers 16, 20, and 22 are set in positions for introducing a minimum amount of outdoor air. In this state, the AHU controller 24 estimates of the load exerted on the coiling coil (the cooling load) for minimum and maximum flow rates of outdoor air. A transition occurs back to State 3 when the estimated cooling load with maximum outdoor air flow is less than the estimated cooling load with minimum outdoor air flow for a given period of time, denoted as X seconds.

Figure 2:
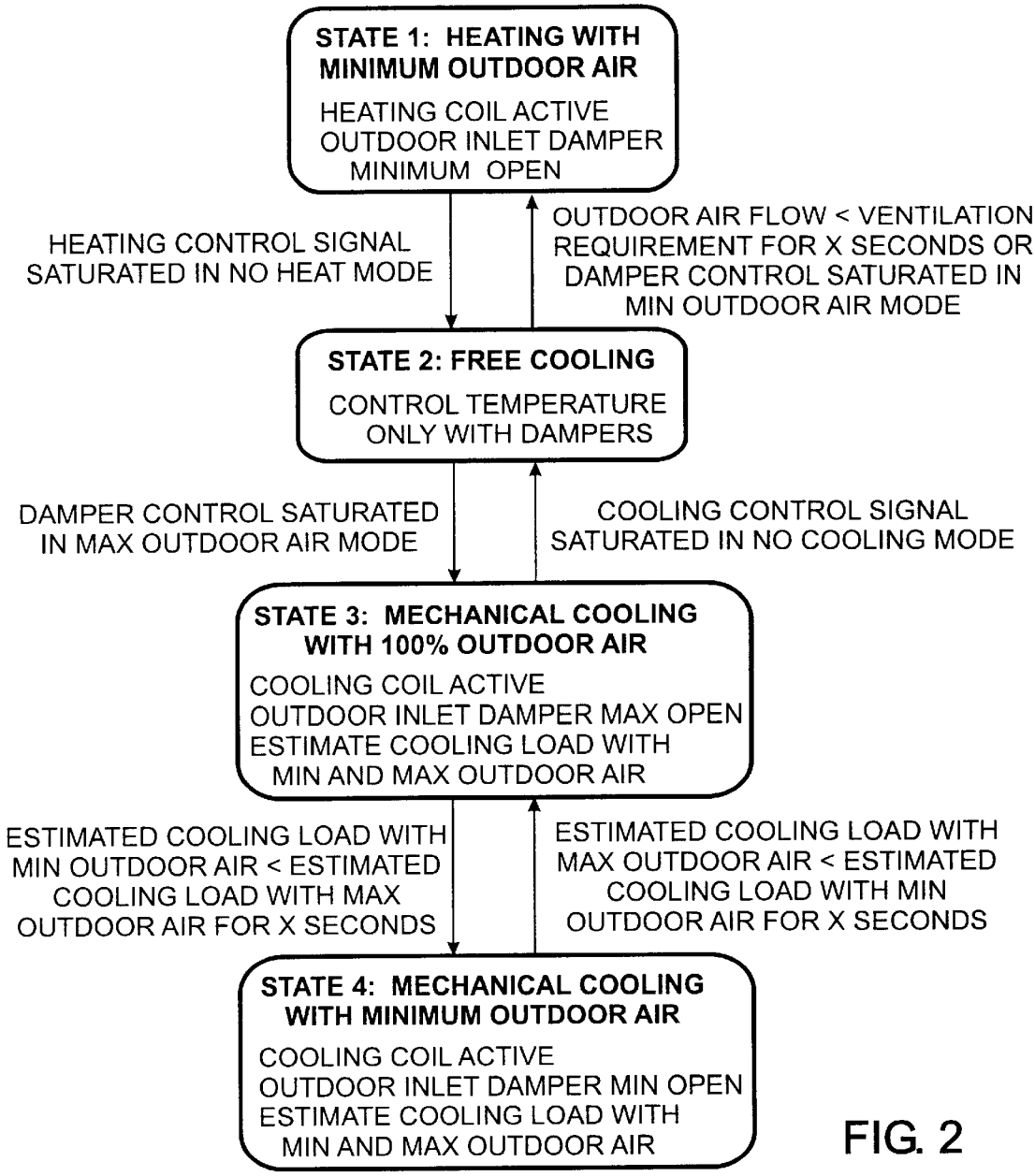
FIG. 2 is a state diagram of a finite state machine with four operating states that is implemented in the controller of the air handling unit in FIG. 1.

In the control strategy implements by the four states illustrated in FIG. 2, the dampers 16, 20 and 22 have only two positions corresponding to the introduction of minimum and maximum amounts of outdoor air. Some air handling units enable the dampers to assume various positions between the minimum and maximum outdoor air positions. This enables another mechanical cooling state in which the positions of the dampers are varied between the extreme minimum and maximum positions to introduce an optimal fraction of outdoor air into the air handling unit 10. This additional state is represented by State 5 in FIG. 4.

States 1, 2 and 3 are essentially the same as those shown in FIG. 2 with the identical conditions specifying when transitions arc to occur between adjacent ones of those three states. However when the AHU controller 24 is operating in State 3, an estimate of the cooling load with an optimal fraction of outdoor air flowing in to the room of the building is derived, in addition to estimates of the cooling load with minimum and maximum flow rates of outdoor air. These three estimates also are derived in States 4 and 5.

A transition can occur from State 3 to either State 4 or 5 depending upon the values of these cooling load estimates. The transition occurs to State 4 when the estimated cooling load with maximum outdoor air $\dot{Q}_{MAX}$ is greater than the estimated cooling load with minimum outdoor air $\dot{Q}_{MIN}$ for a period of X seconds. The transition occurs to State 5 when the estimated cooling load with maximum outdoor air $\dot{Q}_{MAX}$ is greater than the estimated cooling load with an optimal fraction of outdoor air $\dot{Q}_{OPT}$ for a period of X seconds.

In State 4, the cooling coil is active to apply mechanical cooling to the air while the dampers are set in the minimum outdoor air positions. A transition occurs to State 3 when the estimated cooling load with minimum outdoor air $\dot{Q}_{MIN}$ is greater than the estimated cooling load with maximum outdoor air $\dot{Q}_{MAX}$ for a period of X seconds. A transition occurs from State 4 to State 5 when the estimated cooling load with minimum outdoor air $\dot{Q}_{OPT}$ is greater than the estimated cooling load with the optimal fraction of outdoor air $\dot{Q}_{OPT}$ for a period of X seconds.

In State 5, the valve 27 for the cooling coil 26 is controlled to modulate the flow of chilled water to remove energy from the circulating air. At this time, the positions of the dampers 16, 20, and 22 are varied to introduce an optimal fraction of outdoor air into the system. A transition occurs to State 3 when the estimated cooling load with optimal fraction of outdoor air $\dot{Q}_{OPT}$ is greater than or equal to the estimated cooling load with the maximum outdoor air $\dot{Q}_{MAX}$ for a period of X seconds. A transition occurs from State 5 to State 4 when the estimated cooling load with the optimal fraction of outdoor air $\dot{Q}_{OPT}$ is greater than or equal to the estimated cooling load with minimum outdoor air $\dot{Q}_{MIN}$ for a period of X seconds.

There are a number of different processes that can be used regulate the dampers to control the fraction of outdoor air in State 5. Three of them are: direct airflow measurement, energy and mass balance, and a model based method.

The direct airflow measurement method requires sensors that measure airflow rate, which enables the fraction of outdoor air in the supply air to be controlled with a feedback controller. Krarti et al, "Experimental Analysis of Measurement and Control Techniques of Outdoor Air Intake Rates in VAV Systems," *ASHRAE Transactions,* Volume 106, Part 2, 2000 describe several well-know methods for directly measuring the outdoor air fraction.

Alternatively, the fraction of outdoor air in the room supply air can be determined by performing energy and mass balances. Drees et al., "Ventilation Airflow Measurement for ASHRAE Standard 62-1989", *ASHRAE Journal,* October, 1992; Hays et al., *Indoor Air Quality—Solutions and Strategies,* Mc-Graw Hill, Inc., pages 200–201, 1995; and Krarti et al. (supra) describe methods for determining the fraction of outdoor air in the supply air based on a concentration balance for carbon dioxide. The fraction of outdoor air in the supply air is determined from the expression:

$$f_{oa} = \frac{C_{ra} - C_{sa}}{C_{ra} - C_{oa}} \tag{10}$$

where $C_{ra}$ is the carbon dioxide concentration of the return air, $C_{sa}$ is the carbon dioxide concentration of the supply air, and $C_{oa}$ is the carbon dioxide concentration of the outdoor air.

Performing mass balances on the water vapor and air entering and leaving the room gives:

$$f_{oa} = \frac{\omega_{ra} - \omega_{ma}}{\omega_{ra} - \omega_{oa}} \tag{11}$$

where $\omega_{ra}$ is the humidity ratio of the return air, $\omega_{ma}$ is the humidity ratio of the mixed air, and $\omega_{oa}$ is the humidity ratio of the outdoor air.

Performing an energy and mass balance on the air entering and leaving the room gives:

$$f_{oa} = \frac{h_{ra} - h_{ma}}{h_{ra} - h_{oa}} \tag{12}$$

where $h_{ra}$ is the enthalpy of the return air, $h_{ma}$ is the enthalpy of the mixed air, and $h_{oa}$ is the enthalpy of the outdoor air.

Assuming constant specific heats for the return air, mixed air, and outdoor air yields:

$$f_{oa} = \frac{T_{ra} - T_{ma}}{T_{ra} - T_{oa}} \tag{13}$$

An estimate of the fraction of outdoor air in the supply air can be determined from a model of the airflow in the air-handling unit, as described by Seem et al., in "A Damper Control System for Preventing Reverse Airflow Through The Exhaust Air Damper of Variable-Air-Volume Air-Handling Units" , *International Journal of Heating, Ventilating, Air-Conditioning and Refrigerating Research,* Volume 6, Number 2, pp. 135–148, April 2000 which presents equations for modeling the airflow in an air-handling unit are reviewed, see also U.S. Pat. No. 5,791,408, the descriptions in both documents being incorporated herein by reference. The desired damper position can be determined based on the desired fraction of outdoor air and the airflow model, the desired damper position can be determined.

One-dimensional optimization is applied to the fraction of outdoor air in the supply air to determine the optimal fraction which provides the minimal mechanical cooling load. Any of several well-known optimization techniques may be employed, such as the ones described by Richard P. Brent in *Algorithms for Minimization without Derivatives,* Prentice-Hall Inc., Englewood Cliffs, N.J., 1973 or Forsythe, Malcolm, and Moler in *Computer Methods for Mathematical Computations,* Prentice Hall, Englewood Cliffs, N.J., 1977. Alternatively, the "fminband" function contained in the Matlab software package available from The Mathworks, Inc., Natick MA 01760 U.S.A. may be used to find the optimal fraction of outdoor air.

Figure 4:
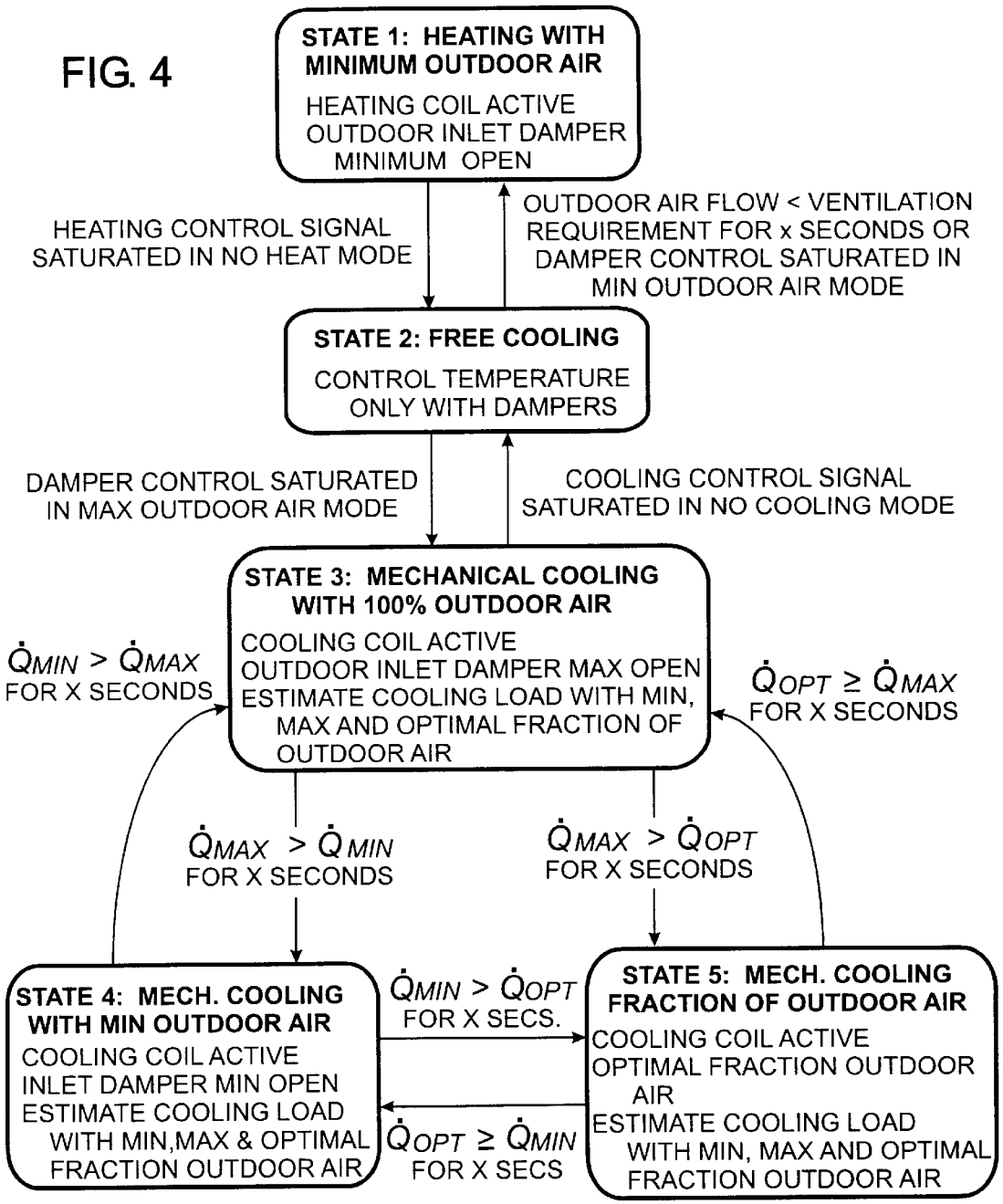
FIG. 4 is a state diagram of an alternative finite state machine having five states.
Figure 5:
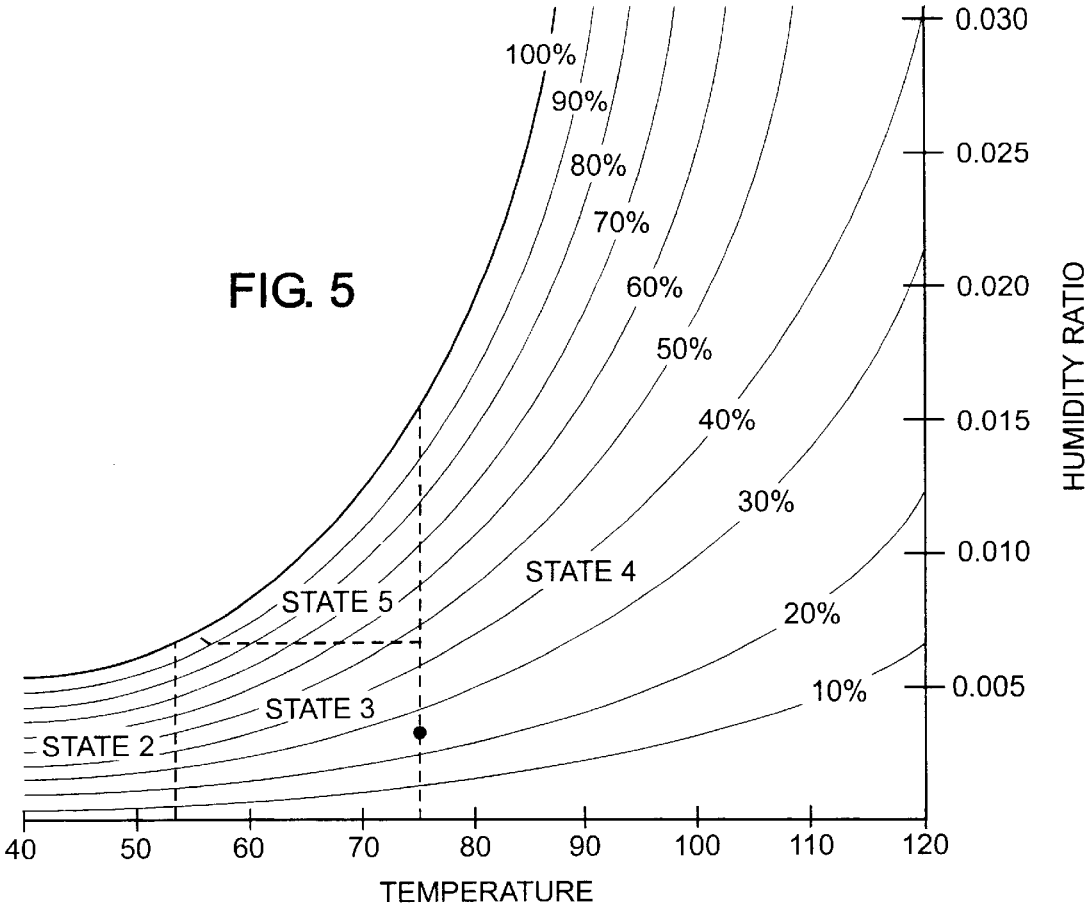
FIG. 5 is an exemplary psychometric chart depicting to operation of the five states represented in FIG. 4 for a specific set of environmental conditions.

The estimated cooling load equations described previously with respect to the four state controller in FIG. 2 are applied to the five state controller depicted in FIG. 4 to determine regions on a psychometric chart where the air-handling controller will operate in the different states. Assuming that the minimum fraction of outdoor air was set to 20% for the return conditions, a coil bypass factor of 0.1, and return air having a temperature of 24° C. and 25% relative humidity, FIG. 5 graphically depicts the control state regions on a psychometric chart.

What is claimed is:

1. A method for operating a system which regulates an amount of outdoor air that is introduced into a building and operates a mechanical temperature control device that varies temperature in the building, said method comprising:

calculating a first load on the mechanical temperature control device assuming that outdoor air flows into the building at a first flow rate;

calculating a second load on the mechanical temperature control device assuming that outdoor air flows into the building at a second flow rate;

performing a comparison of the first load and the second load; and varying the flow of outdoor air into the building in response to the comparison.

2. The method as recited in claim 1 wherein the first load and the second load act on a mechanical temperature control device that cools air in the building.

3. The method as recited in claim 1 wherein the first flow rate is a maximum rate at which outdoor air can enter the building through the system.

4. The method as recited in claim 1 wherein the second flow rate is a minimum rate at which outdoor air can enter the building through the system.

5. The method as recited in claim 1 wherein varying the flow of outdoor air into the building comprises:

introducing outdoor air into the building at the first flow rate when the first load is less than the second load; and introducing outdoor air into the building at the second flow rate when the second load is less than the first load.

6. The method as recited in claim 1 further comprising:

deriving a fractional flow rate of outdoor air which is between the first flow rate and the second flow rate;

calculating a third load on the mechanical temperature control device assuming that outdoor air flows into the building at the fractional flow rate; and wherein performing a comparison also compares the third load to the first load and the second load.

7. The method as recited in claim 6 wherein deriving a fractional flow rate of outdoor air is determined from a model of the airflow in the system.

8. The method as recited in claim 6 wherein varying the flow of outdoor air into the building comprises:

introducing outdoor air into the building at the first flow rate when the second load is greater than the first load and the third load is greater than the first load;

introducing outdoor air into the building at the second flow rate when the first load is greater than the second load and the third load is greater than the second load; and introducing outdoor air into the building at the fractional flow rate when the second load is greater than the third load and the first load is greater than the third load.

9. A method for operating a system which regulates a position of a damper through which outdoor air is introduced into the building and operates a mechanical temperature control device that varies temperature in the building, said method comprising:

calculating a first load on the mechanical temperature control device assuming that the damper is in a first position;

calculating a second load on the mechanical temperature control device assuming that the damper is in a second position; and adjusting the position of the damper in response to the first load and the second load.

10. The method as recited in claim 9 wherein the first position is a maximum open position of the damper.

11. The method as recited in claim 9 wherein the second position of the damper is where a minimum amount of outdoor air is introduced into the building.

12. The method as recited in claim 9 wherein adjusting the position of the damper comprises:

placing the damper into the first position when the first load is less than the second load; and placing the damper into the second position when the second load is less than the first load.

13. The method as recited in claim 9 wherein the first position is a maximum open position and the second position is where a minimum amount of outdoor air is introduced into the building; and further comprising:

deriving a fractional position for the damper which is between the first position and the second position;

calculating a third load on the mechanical temperature control device assuming that the damper is in the fractional position; and wherein adjusting the position of the damper also is in response to the third load.

14. The method as recited in claim 13 wherein deriving a fractional amount of outdoor air is determined from a model of the airflow through the damper.

15. The method as recited in claim 13 wherein adjusting the position of the damper comprises:

placing the damper into the first position when the second load is greater than the first load and the third load is greater than the first load;

placing the damper into the second position when the first load is greater than the second load and the third load is greater than the second load; and placing the damper into the fractional position when the second load is greater than the third load and the first load is greater than the third load.

16. A method for operating a finite state machine controller which operates a flow control device which regulates an amount of outdoor air that is introduced into the building and operates a mechanical temperature control device that varies temperature in the building, said method comprising:

operating in a first state in which the flow control device is operated to introduce outdoor air into the building at a first flow rate;

operating in a second state in which the flow control device is operated to introduce outdoor air into the building at a second flow rate;

calculating a first load that would be exerted on the mechanical temperature control device in the first state;

calculating a second load that would be exerted on the mechanical temperature control device in the second state; and making transitions between the first state and the second state in response to the first load and the second load.

17. The method as recited in claim 16 wherein the finite state machine operates in the first state when the first load is less than the second load, and in the second state when the second load is less than the first load.

18. The method as recited in claim 16 further comprising:

operating in a third state in which the flow control device is operated to introduce a fractional amount of outdoor air into the building, wherein the fractional amount is between the first amount and the second amount;

calculating a third load that would be exerted on the mechanical temperature control device in the third state; and making transitions between the first state, the second state and the third state in response to the first load, the second load, and the third load.

19. The method as recited in claim 18 wherein the finite state machine controller operates:

in the first state when the second load is greater than the first load and the third load is greater than the first load;

in the second state when the first load is greater than the second load and the third load is greater than the second load; and in the third state when the second load is greater than the third load and the first load is greater than the third load.

20. The method as recited in claim 18 wherein in the third state the fractional amount of outdoor air is derived from a model of the airflow in the system.

* * * * *